US007360380B2

(12) United States Patent
Van Handel

(10) Patent No.: US 7,360,380 B2
(45) Date of Patent: Apr. 22, 2008

(54) LOCK BOX

(75) Inventor: Mark Van Handel, Milwaukee, WI (US)

(73) Assignee: Master Lock Company LLC, Oak Creek, WI (US)

( * ) Notice: Subject to any disclaimer, the term of this patent is extended or adjusted under 35 U.S.C. 154(b) by 117 days.

(21) Appl. No.: 11/264,453

(22) Filed: Nov. 1, 2005

(65) Prior Publication Data

US 2006/0162403 A1 Jul. 27, 2006

Related U.S. Application Data

(60) Provisional application No. 60/623,934, filed on Nov. 1, 2004.

(51) Int. Cl.
*B65D 55/14* (2006.01)

(52) U.S. Cl. ..... 70/63; 70/14; 211/9

(58) Field of Classification Search ..... 70/63, 70/14, 159, DIG. 63, DIG. 71; 211/9, 85.9
See application file for complete search history.

(56) References Cited

U.S. PATENT DOCUMENTS

| | | | |
|---|---|---|---|
| 1,719,120 | A | 7/1929 | Miles |
| 1,877,910 | A | 9/1932 | Enfant |
| 1,877,912 | A | 9/1932 | L'Enfant |
| 2,219,561 | A | 10/1940 | Miller |
| 2,485,051 | A | 10/1949 | Joslin |
| 2,635,665 | A | 4/1953 | Ashley |
| 2,704,101 | A | 3/1955 | Wittrien |
| 2,859,789 | A | 11/1958 | Buckett |
| 2,875,803 | A | 3/1959 | Greene et al. |
| 2,889,050 | A | 6/1959 | Modrey |
| 3,318,354 | A | 5/1967 | Borisof |

(Continued)

FOREIGN PATENT DOCUMENTS

| | | |
|---|---|---|
| CH | 674 395 | 5/1990 |

(Continued)

OTHER PUBLICATIONS

International Search Report and Written Opinion of the International Searching Authority, dated Dec. 20, 2006, pp. 8.

(Continued)

*Primary Examiner*—Suzanne Dino Barrett
(74) *Attorney, Agent, or Firm*—Calfee, Halter & Griswold LLP

(57) ABSTRACT

A lock box that includes a body for storing keys, a lid, and a latching mechanism. The lid is arranged for selectively covering the opening. The body and the lid include securing apertures that are cooperatively positioned when the lid covers the opening. The body and lid also include cutouts that are aligned when the lid covers the opening. The latching mechanism is slideably coupled to the lid and includes a cantilever spring and a tab. The tab passes through the cutouts in the body and lid when the lid covers the opening and the latching mechanism is in a latched position. The cantilever spring is partially located in an aperture in the lid. The position of the cantilever spring is determined by whether the latching mechanism is latched or unlatched. The lock box when secured can require the cooperation of multiple users to open.

26 Claims, 8 Drawing Sheets

U.S. PATENT DOCUMENTS

| | | | |
|---|---|---|---|
| 3,415,300 | A | 12/1968 | Worcester |
| 3,563,293 | A | 2/1971 | Fisher |
| 3,568,482 | A | 3/1971 | Shears |
| 3,606,777 | A | 9/1971 | Watson |
| 3,716,091 | A | 2/1973 | Gaines |
| 3,926,234 | A | 12/1975 | Dean |
| 3,933,017 | A | 1/1976 | Shee |
| 4,072,033 | A | 2/1978 | Eckerdt |
| 4,286,641 | A | 9/1981 | Watson |
| 4,306,433 | A | 12/1981 | Kelly |
| 4,331,194 | A | 5/1982 | Lederer |
| D275,055 | S | 8/1984 | Davis |
| 4,523,692 | A | 6/1985 | Lemkin |
| 4,653,785 | A | 3/1987 | Tobey |
| 4,796,750 | A | 1/1989 | Inghram |
| 4,799,587 | A | 1/1989 | Desanto |
| 4,901,549 | A | 2/1990 | Dengel |
| 5,020,342 | A | 6/1991 | Doan et al. |
| 5,046,343 | A | 9/1991 | Miwa |
| 5,123,579 | A | 6/1992 | Sugiyama |
| 5,191,974 | A | 3/1993 | Saalman |
| 5,365,757 | A | 11/1994 | Primeau |
| 5,641,065 | A | 6/1997 | Owens et al. |
| 5,653,332 | A | 8/1997 | DeWitt, Jr. |
| 5,738,020 | A | 4/1998 | Correia |
| 5,799,774 | A | 9/1998 | Dengel |
| 5,829,580 | A | 11/1998 | Schroeter |
| 6,047,573 | A | 4/2000 | Martinez |
| D427,901 | S | 7/2000 | Lentini |
| 6,085,671 | A | 7/2000 | Kerr et al. |
| 6,148,993 | A | 11/2000 | Chisolm et al. |
| 6,247,609 | B1 | 6/2001 | Gabele et al. |
| 2002/0108410 | A1 | 8/2002 | Webb et al. |
| 2005/0199628 | A1 | 9/2005 | Van Handel et al. |

FOREIGN PATENT DOCUMENTS

| | | |
|---|---|---|
| FR | 2 773 539 | 7/1999 |

OTHER PUBLICATIONS

International Search Report from PCT/US2005/008409.

International Preliminary Report on Patentability and Written Opinion from PCT/US2005/039418 dated May 10, 2007.

LOCK BOX

CROSS-REFERENCE TO RELATED APPLICATIONS

This non-provisional application claims the benefit of U.S. Provisional Patent Application No. 60/623,934, entitled "Lockbox," filed Nov. 1, 2004.

FIELD OF THE INVENTION

This invention relates generally to lock boxes and relates specifically to lock boxes equipped with latching mechanisms.

BACKGROUND OF THE INVENTION

The ability to secure a valuable item is always of considerable concern. Lock boxes are one method of storing valuable items, such as one or more keys in an industrial setting. Lock boxes normally have a lid or other such cover, which can be removed or opened to reveal a storage compartment. These lock boxes normally include one locking mechanism that can secure the storage area. A need exists in the art for a lock box that provides secure storage and increased security for keys and other valuable items.

SUMMARY OF THE INVENTION

This invention is directed to apparatus and methods for storing and securing keys in lock boxes. The apparatus and methods are designed to allow multiple individuals to secure or lock keys in a lock box.

An embodiment of the invention provides for a lock box that includes a body, a lid, and a latching mechanism. The body defines an opening to a storage area for keys. The lid is arranged for selectively covering the opening. The body and the lid include securing apertures that are cooperatively positioned when the lid covers the opening. The body and lid also include cutouts that are aligned when the lid covers the opening. The latching mechanism is slideably coupled to the lid and includes a cantilever spring and a tab. The tab passes through the cutouts in the body and lid when the lid covers the opening and the latching mechanism is in a latched position. The cantilever spring is partially located in an aperture in the lid. The position of the cantilever spring is determined by whether the latching mechanism is latched or unlatched.

Further features and advantages of the invention will become apparent from the following detailed description made with reference to the accompanying drawings.

DESCRIPTION OF THE DRAWINGS

In the accompanying drawings, which are incorporated in and constitute a part of this specification, embodiments of the invention are illustrated, which, together with a general description of the invention given above, and the detailed description given below serve to illustrate the principles of this invention. The drawings and detailed description are not intended to and do not limit the scope of the invention or the claims in any way. Instead, the drawings and detailed description only describe embodiments of the invention and other embodiments of the invention not described are encompassed by the claims.

DETAILED DESCRIPTION

This Detailed Description of the Invention merely describes embodiments of the invention and is not intended to limit the scope of the invention in any way. Indeed, the invention as described in the claims is broader than and unlimited by the preferred embodiments, and the terms used have their full ordinary meaning.

Figure 1:
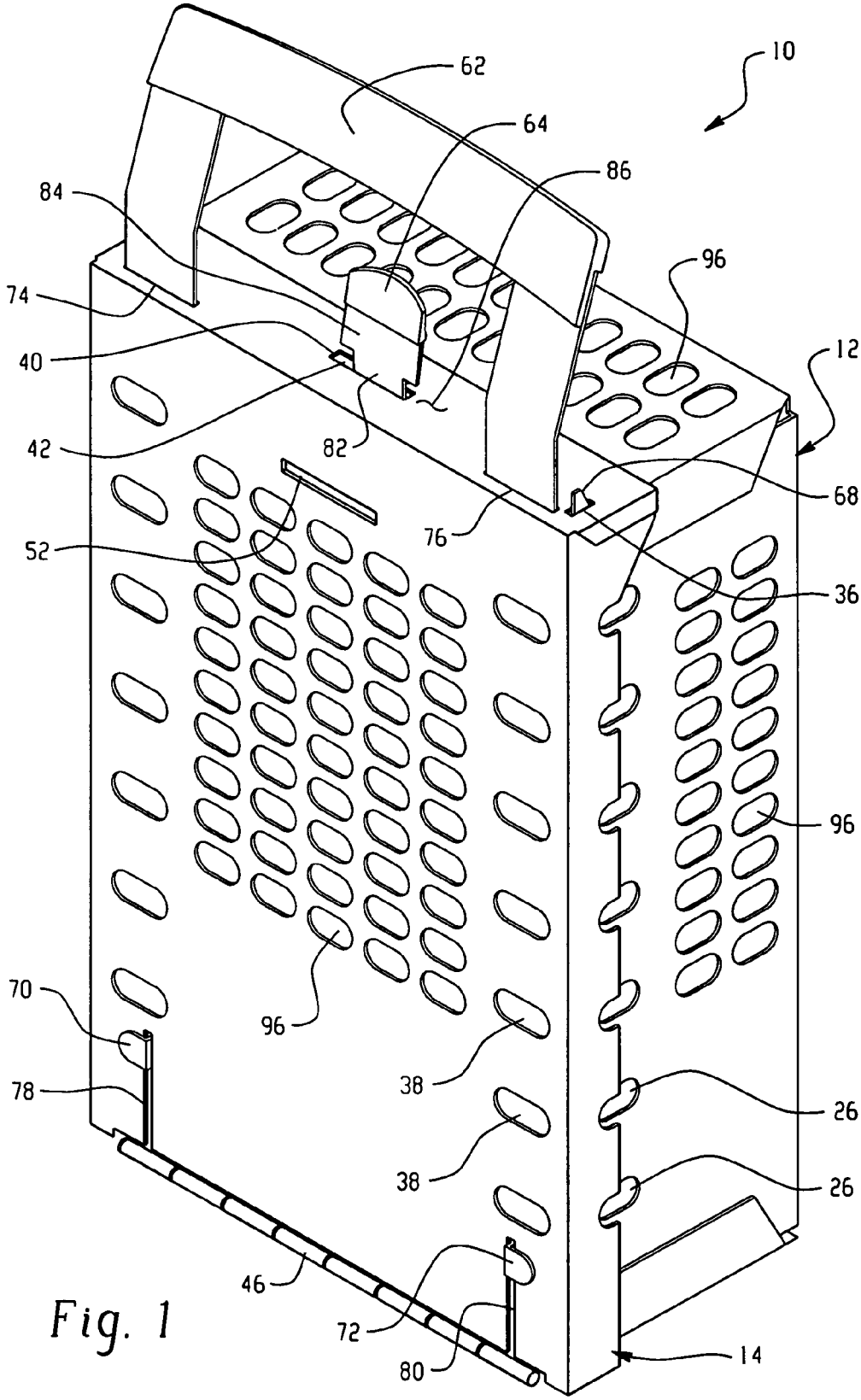
FIG. 1 is a perspective view of a lock box constructed in accordance with an embodiment of the present invention.
Figure 2:
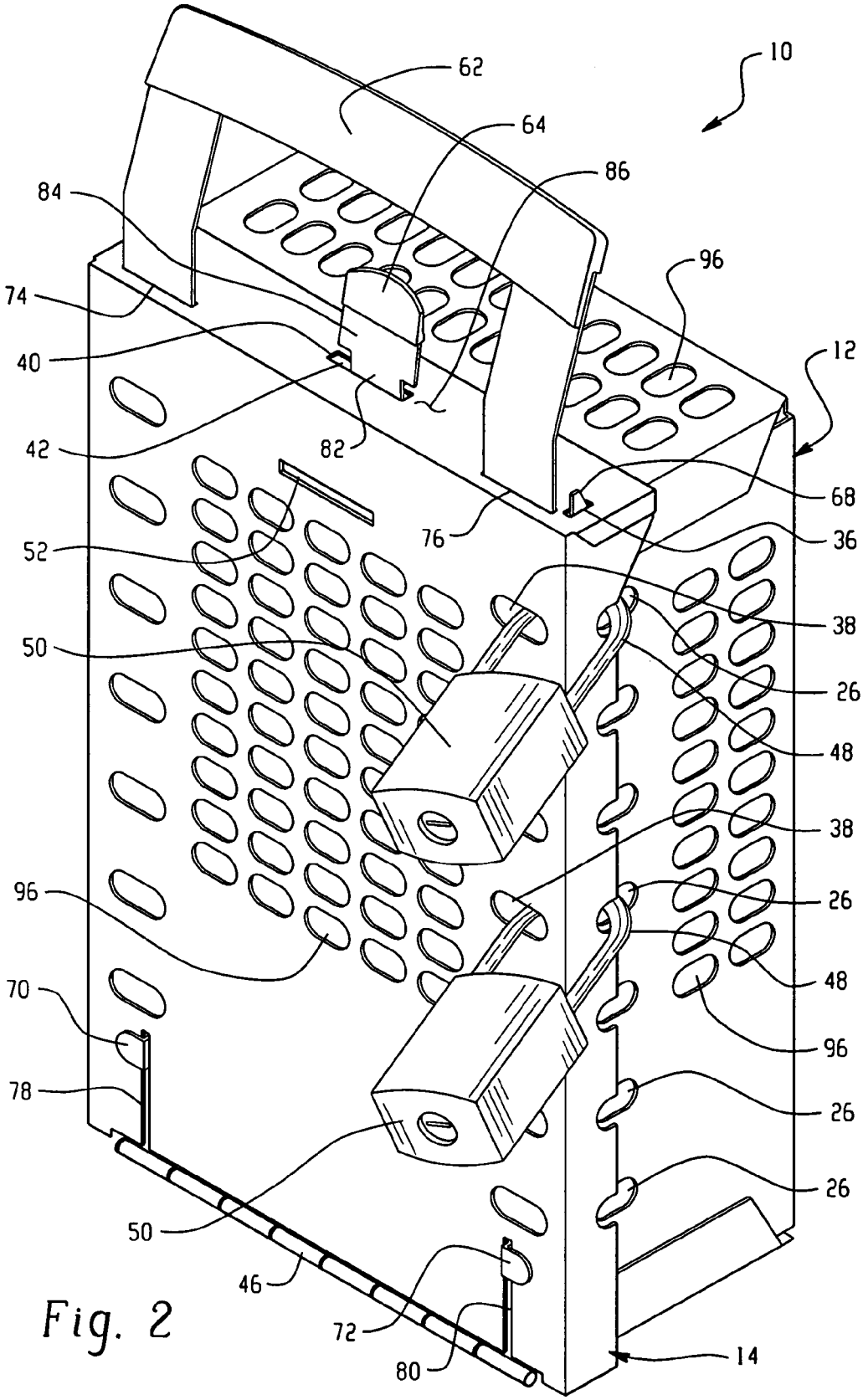
FIG. 2 is a perspective view of the lock box shown in FIG. 1, showing the lock box secured with a plurality of locks.
Figure 8:
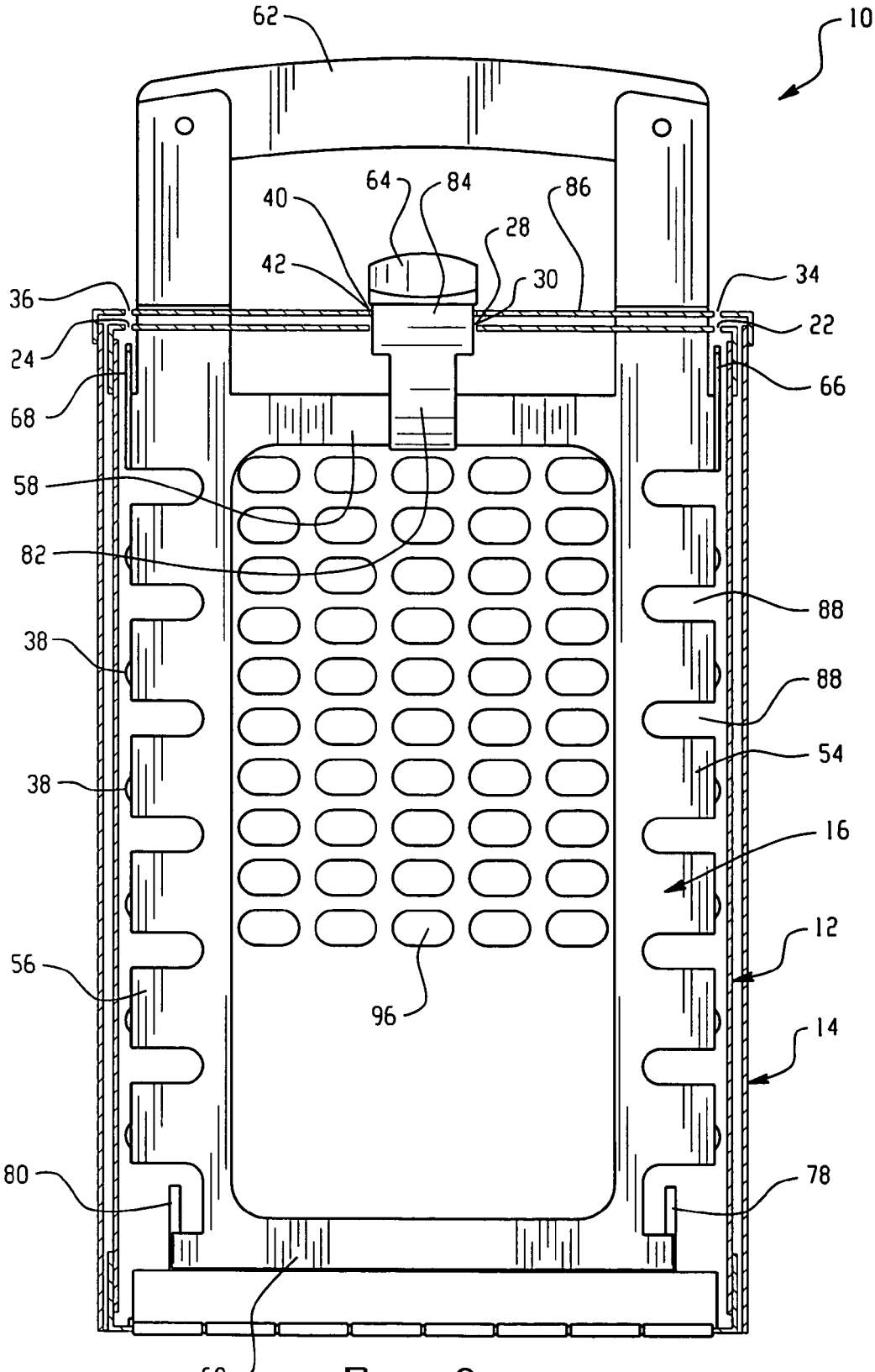
FIG. 8 is a cross-sectional view of the lock box in FIG. 1, taken along the line A-A of FIG. 6, with a latching mechanism in an unlatched position.
Figure 9:
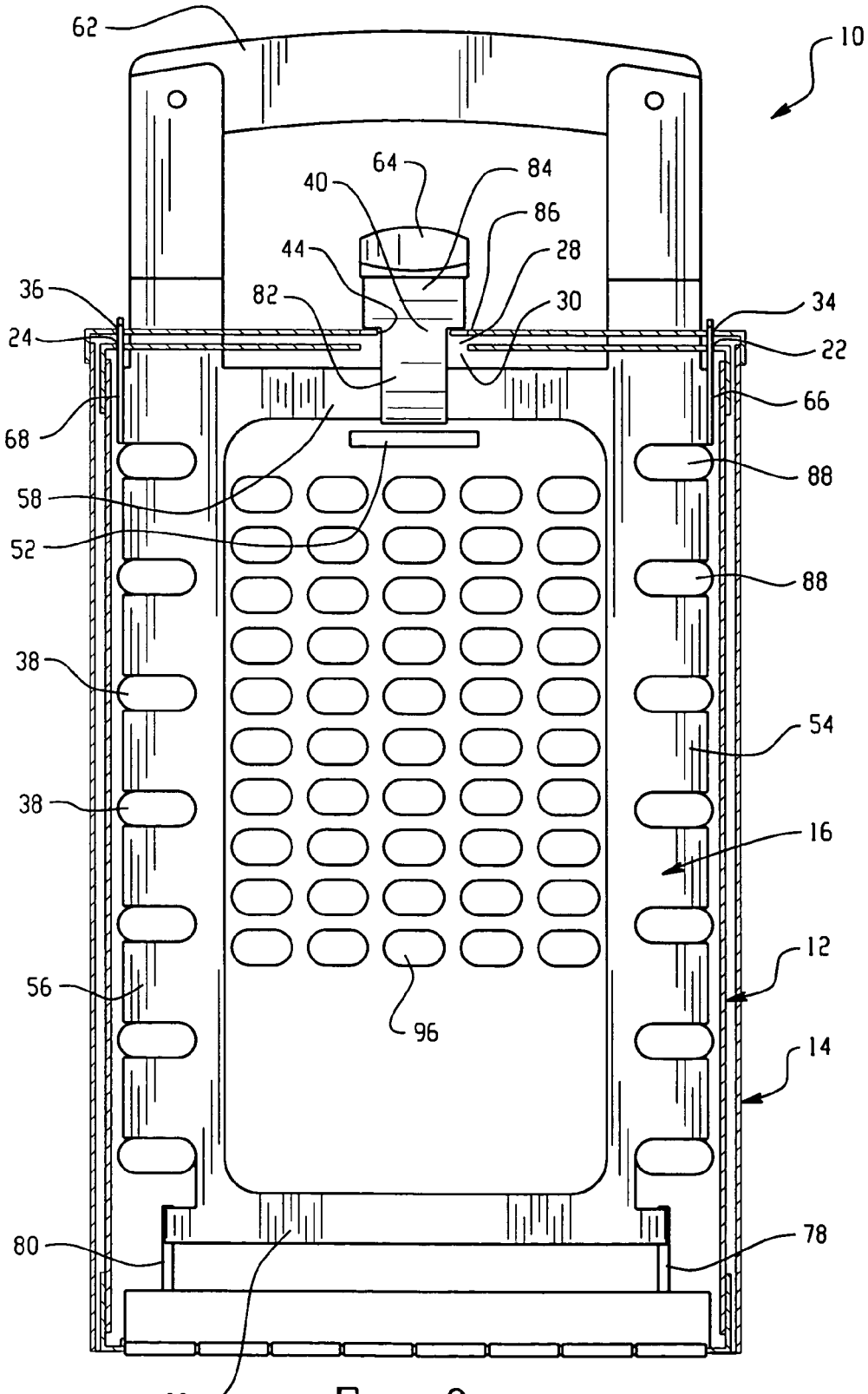
FIG. 9 is a cross-sectional view of the lock box in FIG. 1, taken along the line A-A of FIG. 6, with the latching mechanism in a latched position.
Figure 10:
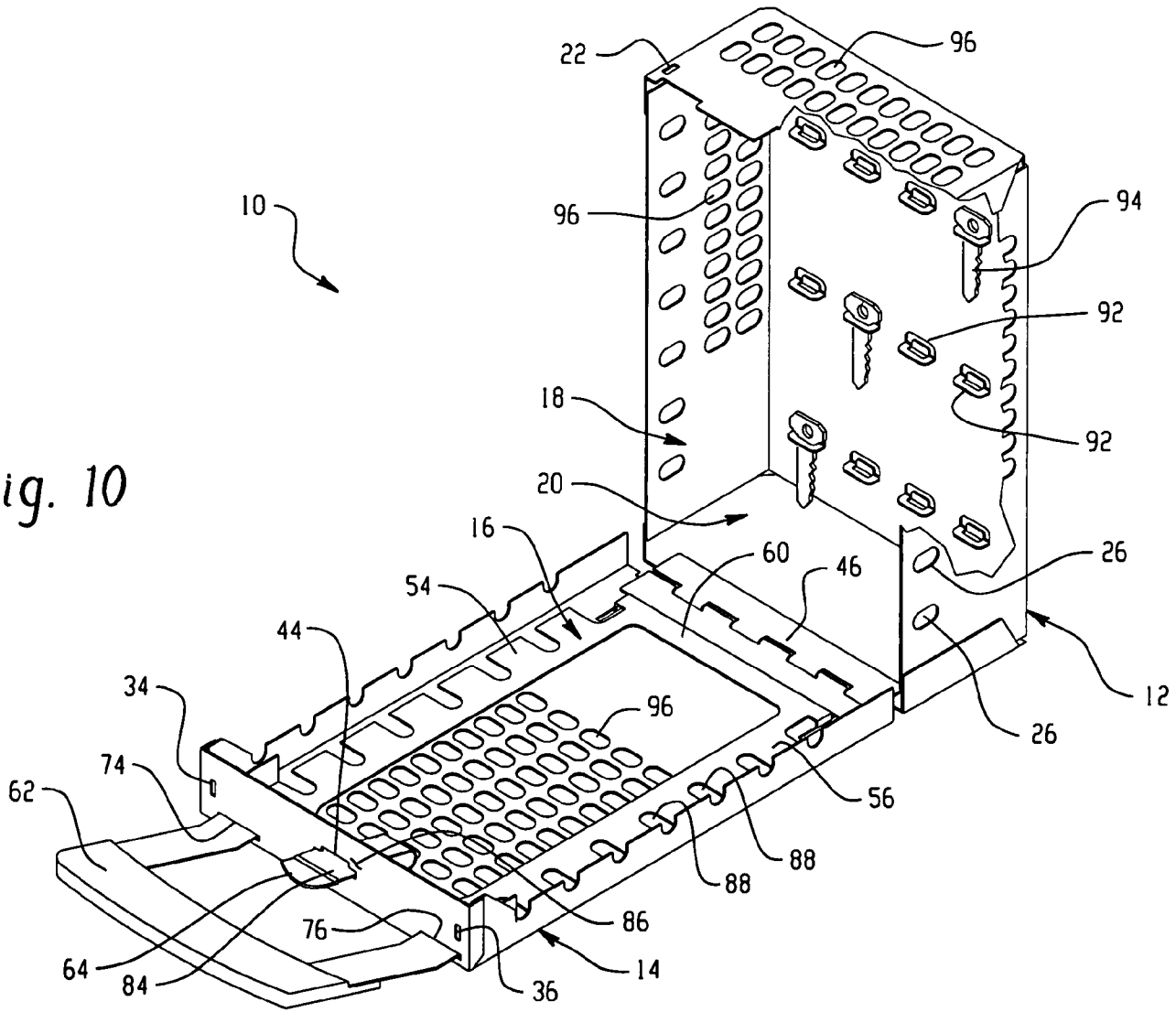
FIG. 10 is a perspective view of the lock box shown in FIG. 1 with the lid open and keys stored in holders.

An exemplary illustration of a lock box 10 is shown in FIGS. 1 through 10. A lock box 10 is typically constructed or manufactured from sheet metal, but can be made of any durable materials, such as wood or plastic. The lock box 10 includes a body or a shell 12, a lid 14, and a latching mechanism 16. The lid 14 can be selectively opened or closed onto the body 12. FIG. 1 shows the lock box 10 with the lid 14 closed onto the body 12, while FIG. 10 shows the lock box 10 with the lid 14 open. The latching mechanism 16 can be selectively placed in latched and unlatched positions. When the lid 14 is closed and the latching mechanism 16 is in a latched position, the lid 14 can not be opened. To enable the lid 14 to open, the mechanism 16 is placed in an unlatched position. In addition, while the lid 14 is closed, the lid 14 can be secured to the body 12 by a plurality of locks or other securing devices, as shown in FIG. 2.

Figure 3:
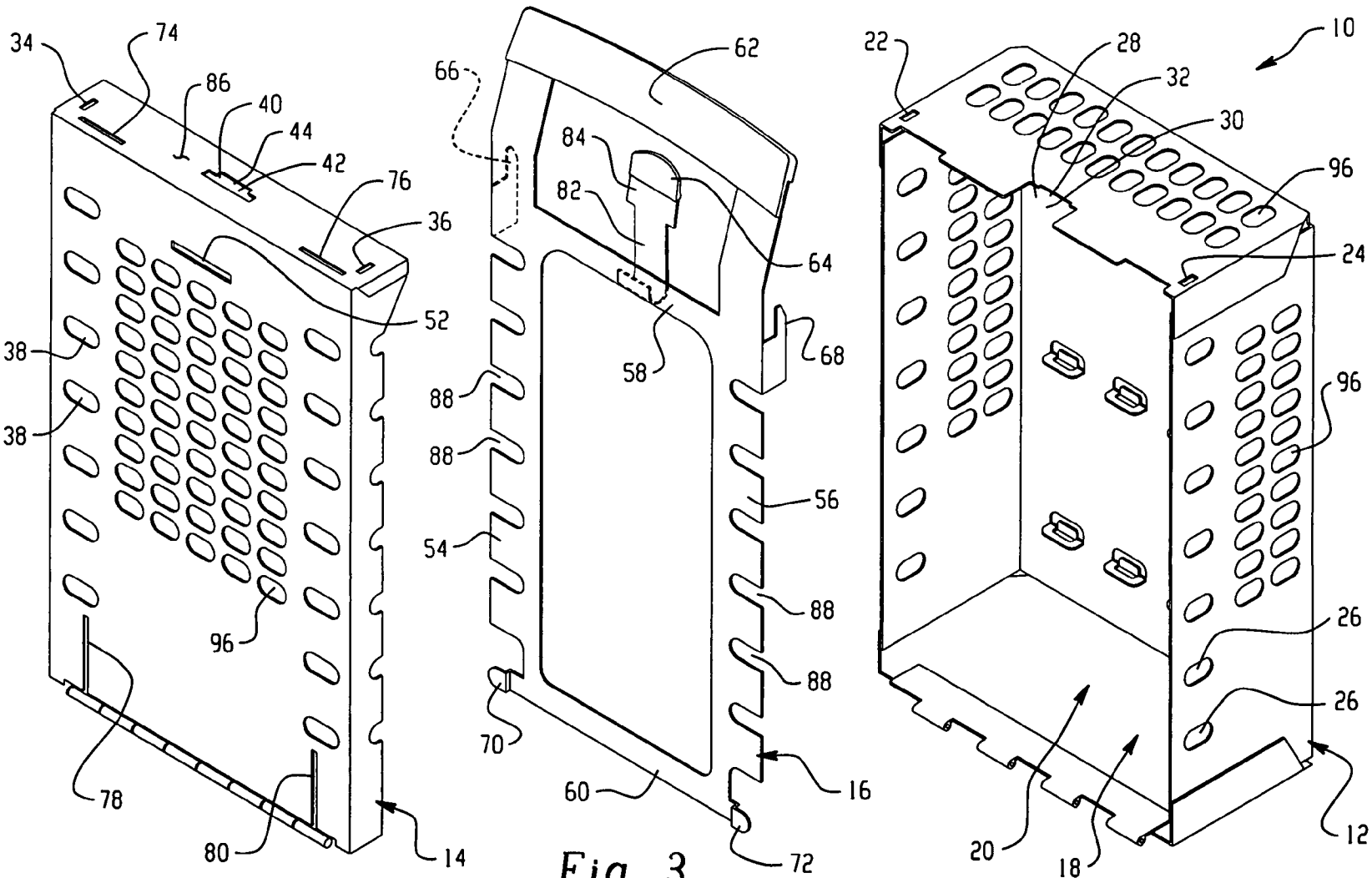
FIG. 3 is an exploded view of the lock box shown in FIG. 1.
Figure 5:
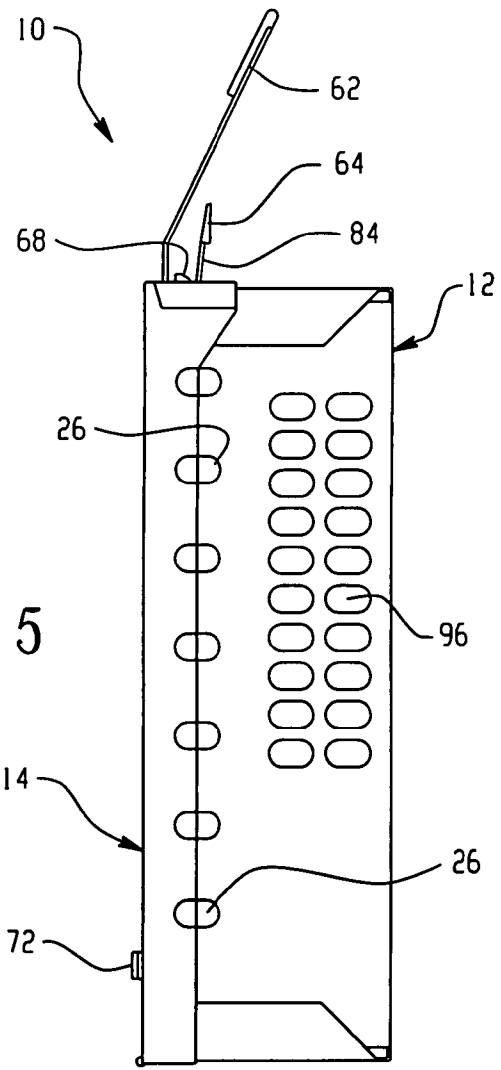
FIG. 5 is a side elevation view of a lock box shown in FIG. 1.
Figure 4:
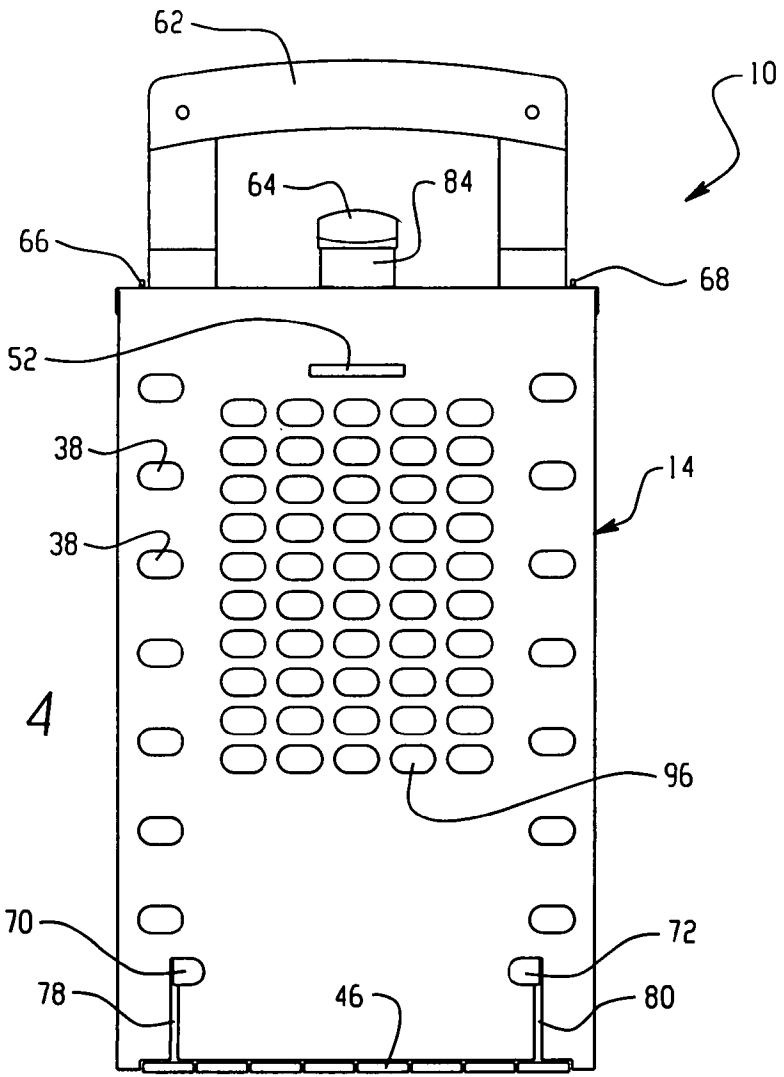
FIG. 4 is a front elevation view of the lock box shown in FIG. 1.

As best shown in FIG. 3, the body defines an opening 18 through which a storage area 20 is accessible. A variety of items, such as keys, can be placed and stored in the storage area 20. The body 12 also includes a pair of cutouts 22 and 24 and at least one securing or lock-receiving aperture 26. As shown, the body 12 includes a plurality of securing apertures 26. The body 12 can optionally include a notch 28. The notch 28 typically includes two sections or portions. The first section 30 is located proximate to the edge of the body 12. The second section 32 is centered on the first section 30 and positioned away from the edge of the body 12. The width of the first section 30 of the notch 28 is greater than the width of the second section 32 of the notch 28.

Still referring to FIG. 3, the lid 14 includes a pair of cutouts 34 and 36 and at least one securing or lock-receiving aperture 38. As shown, the lid includes a plurality of securing apertures 38. The lid 14 also includes a cantilever spring aperture 40. This aperture 40 is shaped similarly to the notch 28 described above. The aperture 40 has a first section 42 and a second section 44 positioned next to each other, where the second section 44 is centered on the first section 42 and the width of the first section 42 is greater than the width of the second section 44.

As the lid 14 is selectively opened and closed onto the body 12, the lid 14 is positioned to uncover and cover the opening 18 and reveal or enclose the storage area 20 defined by the body 12. A hinge 46 can pivotally couple the lid 14 to the body 12 to facilitate the opening and closing of the lid 14. When the lid 14 is closed on the body 12 such as to cover the opening 18, the cutouts 22 and 24 in the body 12 align with the cutouts 34 and 36 in the lid 14, respectively (as best seen in FIG. 8). Similarly, the notch 28 in the body 12 aligns with the cantilever spring aperture 40 in the lid 14. As will be described below, the alignment of the cutouts (22 to 34) and (24 to 36) enable the latching mechanism 16 to hold the lid 14 closed on the body 12 when the latching mechanism 16 is in a latched position.

When the lid 14 is closed, the securing apertures 26 in the body 12 are positioned proximate to the securing apertures 38 in a lid 14. As shown in FIG. 2, securing apertures 26 and 38 can be cooperatively positioned in such a manner to allow for a shackle 48 of a pad lock 50 to pass through the apertures 26 and 38 and secure the lid 14 to the body 12. Although a conventional pad lock 50 is shown, a variety of locking mechanism may be used to secure the lid 14 to the body 12, such as for example, a combination lock, a cable lock, or passing a cable through the apertures 26 and 38 and securing the cable with a lock. The lid 14 may optionally include a key slot 52. This slot 52 allows for depositing of keys or other similarly sized items into the storage area 20 when the opening 18 is covered by the lid 14. The slot 52 remains accessible for key insertion when the lid 14 is locked to the body 12.

In the lock box illustrated in the Figures, the body 12 includes a plurality of securing apertures 26 and the lid 14 includes a plurality of corresponding securing apertures 38. Consequently, the lock box 10 can be secured by a plurality of individuals placing locks through corresponding pairs of securing apertures 26 and 38. The lock box 10 can be secured in such a manner that each individual must authorize the removal of a lock from the lock box 10 in order for the storage area 20 to be accessed. Referring to FIG. 2, if two different individuals placed a pad lock 50 on the lock box 10 to secure the lock box 10, each individual must independently remove their respective lock 50 before the lid 14 can be opened. This arrangement can be useful in many situations. For example, when a tool room in a manufacturing facility should only be open when two supervisors are present. In this situation, the key to the tool room can be stored in the lock box 10 and the lock box 10 can be secured as shown in FIG. 2. Each supervisor controls one of the locks 50. As a result, the tool room can only be opened when both supervisors are present to unlock the lock box 10 so the key to the tool room can be retrieved. The supervisors could place the locks 50 back on the lock box 10 as soon as the key to the tool room is retrieved so that any remaining items in the lock box 10 are secured. When the supervisors no longer need the tool room key, either supervisor could return the key to the lock box 10 without opening the lock box 10 by simply placing the key through the key slot 52 in the lid 14. Requiring the cooperation of multiple users to access a lock box can be applied to many other applications, such as for example, securing a key that starts a piece of potentially dangerous industrial equipment, or securing a key that stops an important processing line that requires a lengthy and expensive start-up. Regardless of the application, requiring two or more users to cooperatively access the lock box decreases the chance of unauthorized or accidental access to any key stored within the lock box.

Referring again to FIG. 3, the latching mechanism 16 includes two legs 54 and 56 connected by top 58 and bottom 60 connection members and a handle 62 extending from the legs 54 and 56. A cantilever spring 64 is attached to the top connection member 58. A pair of tabs 66 and 68 extend from the legs 54 and 56 and a pair of tongues 70 and 72 extend from the bottom connection member 60. The latching mechanism 16 is coupled to the inside of the lid 14 such that the mechanism 16 can slide along the inside of the lid 14. As best seen in FIG. 1, the latching mechanism 16 is coupled to the lid 14 by the cantilever spring 64, which passes through the cantilever spring aperture 40; the handle, which passes through a pair of handle apertures 74 and 76 located in the lid 14; and the pair of tongues 70 and 72 positioned in a pair of slits 78 and 80, respectively, in the lid 14. This arrangement restricts the latching mechanism 16 to only moving vertically and linearly (with respect to FIG. 1) along the inside of the lid 14.

When the lid 14 is positioned to cover the opening 18, the latching mechanism 16 can be placed in either a latched position or an unlatched position. The latching mechanism 16 is generally placed in the latched position (as shown in FIG. 9) by moving the mechanism 16 vertically upward with respect to the lid 14. The mechanism 16 is generally placed in the unlatched position (as shown in FIG. 8) by moving the mechanism 16 vertically downward with respect to the lid 14. The interaction of the cantilever spring 64 and the cantilever spring aperture 40 in the lid 14 can enable the movement of the latch mechanism 16 in addition to holding the mechanism 16 in a latched position.

As best seen in FIGS. 8 and 9, the cantilever spring 64 is T-shaped and includes two sections or portions, a main section 82 extending from the point of attachment to the top connection member 58 and an actuation section 84 extending from the main section 82. The width of the actuation section 84 is greater than the width of the main section 82. The main section 82 is sized such that it can be accommodated by either the first or second section 42 and 44 of the cantilever spring aperture 40. The actuation section 84 is sized such that it can be accommodated only by the first section 42 and not the second section 44 of the cantilever spring aperture 40.

The manner in which the latching mechanism 16 is assembled with the lid 16 is such that the cantilever spring 64 is biased to move towards the second section 44 of the cantilever spring aperture 40. When the latching mechanism 16 is in an unlatched position, as shown in FIG. 8, the actuation section 84 of the spring 64 is located in the wider first section 42 of the aperture 40. As the mechanism 16 is moved upward towards the latched position, as shown in FIG. 9, the actuation section 84 of the spring 64 moves out of the aperture 40 and the bias of the spring 64 moves the main section 82 of the spring 64 into the narrower second section 44 of the aperture 40. The bias of the spring 64 is such that as the latching mechanism 16 is moved upward, the main section 82 of the spring 64 will snap or self-locate into second section 44 of the aperture 40. In this position, the bottom of the actuation section 84 rests on the surface 86 of the lid 14 and acts as a stop to resist downward movement of the mechanism 16.

To move the mechanism 16 out of the latched position to an unlatched position, the actuation section 84 can be actuated or manually pulled towards the front of the lid 14 (or away from the body 12) until the actuation section 84 is clear of the surface 86 of the lid 14 and positioned above the first section 42 of the aperture 40. Once the actuation section 84 is free from contact with the surface 86 of the lid 14 and positioned above the first section 42, the latching mechanism 16 can be moved downward, such that the actuation section 84 passing into the first section 42 of the cantilever spring aperture 40. The handle 62 is typically used to move or slide the latching mechanism 16 upward and downward along the inside of the lid 14.

As described previously, when the lid 14 is closed the cantilever spring aperture 40 aligns with the notch 28 in the body 12. The first section 42 of the aperture 40 generally aligns with the first section 30 of the notch 28 and the second section 44 of the aperture 40 generally aligns with the second section 32 of the notch 28. This alignment allows the body 12 to reinforce the lid 14 when the latching mechanism 16 is in a latched position. As the actuation section 44 rests on the surface 86 of the lid 14, any force placed on the lid 14 by the actuation section 44 is also absorbed by the body 12 due to the alignment of the notch 28 and aperture 40.

Although the interaction of the cantilever spring 64 and the cantilever spring aperture 40 controls the latching and unlatching of the latching mechanism 16, the spring 64 and aperture 40 do not hold the lid 14 in a closed position when the mechanism 16 is latched. The lid 14 is held closed by the tabs 66 and 68 of the latching mechanism 16. As mentioned above, when the lid 14 is closed, the cutouts 34 and 36 in the lid 14 align with the cutouts 22 and 24 in the body 12, respectively (as shown in FIG. 8). As the latching mechanism 16 is moved upward from an unlatched position towards a latched position, the tabs 66 and 68 pass through the aligned cutouts (22, 34) and (24, 36) (as seen in FIG. 9). When the mechanism 16 is in the latched position, the tabs 66 and 68 interfere with the cutouts (22, 34) and (24, 36), respectively, to prevent the lid 14 from being opened. Although the embodiments illustrated herein show a pair of tabs 66 and 68, it should be understood that a single tab or any number of tabs can be arranged to hold the lid 14 closed when the latching mechanism 16 is latched.

The latching mechanism 16 can optionally include a plurality of notches 88 located along outside edges of the legs 54 and 56. The notches 88 selectively align with the securing apertures 38 in the lid 14. When the latching mechanism 16 is in a latched position the notches 88 align with the apertures 38, as seen in FIG. 9. This arrangement allows a shackle 48 of a lock 50, for instance, to pass through the aperture 38 to secure the lid 14 to the body 12. When the latch mechanism 16 is in an unlatched position the notches 82 are misaligned with the apertures 38, as seen in FIG. 8. This arrangement blocks a shackle 48 of a lock 50 or any other securing device from passing through the aperture 38 to secure the lid 14 to the body 12. Under this arrangement, latching mechanism 16 cannot be unlatched when a lock 50 or other device secures the lid 14 to the body 12. Since some locking devices, such as a cable, can fit loosely into the cooperative securing apertures 26 and 38, if the latching device 16 were able to be unlatched, the lid 14 could be separated from the body 12 even though the lid 14 is locked or secured to the body 12. This could allow some contents of the storage area 20 to pass through any gap created by the separation of the lid 14 and body 12.

Figure 7:
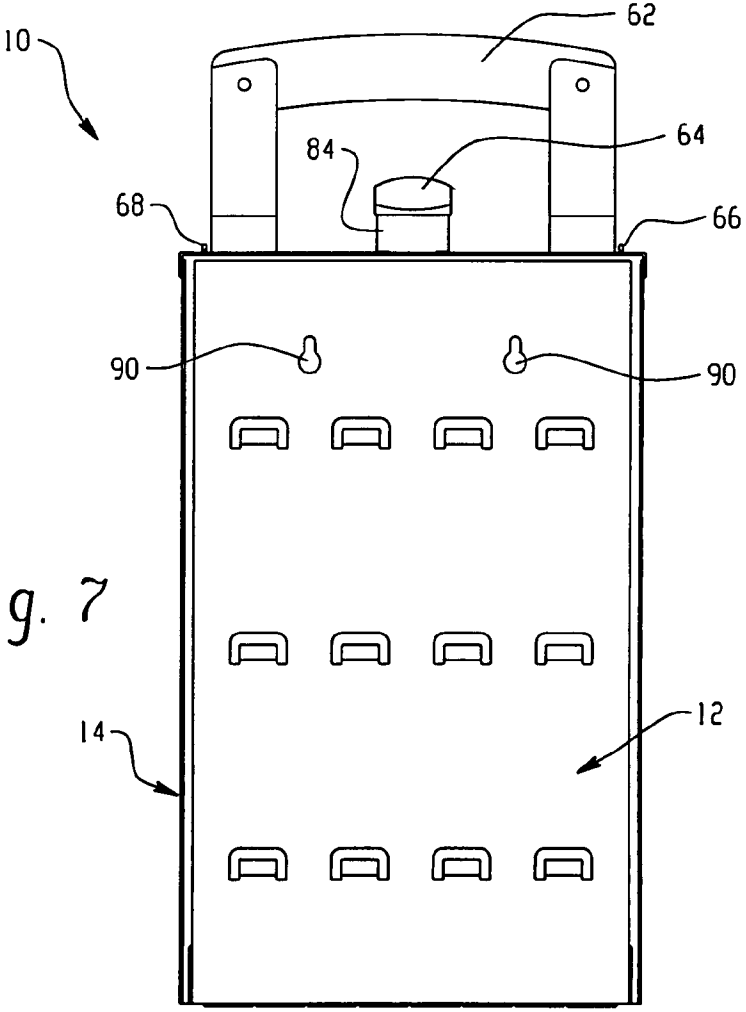
FIG. 7 is a rear view of the lock box shown in FIG. 1.
Figure 6:
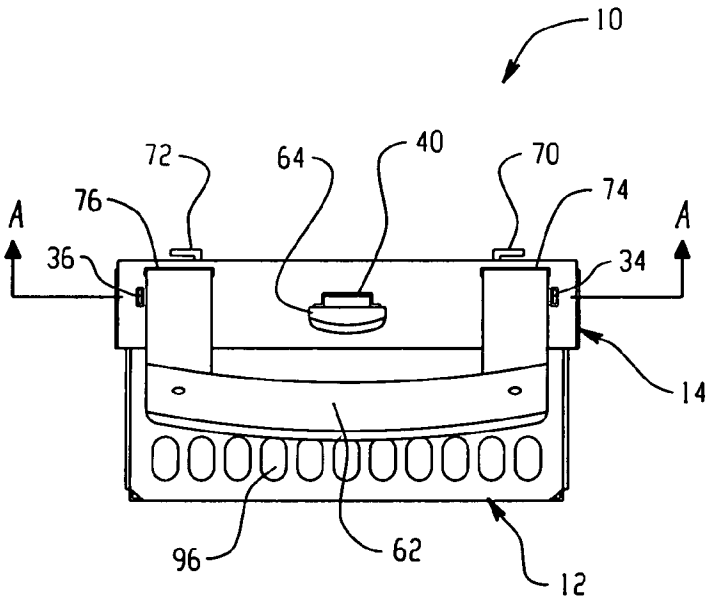
FIG. 6 is a top view of the lock box shown in FIG. 1.

The lock box 10 can be either portable or secured to a specific location. As illustrated, the lock box 10 is portable. Once the box 10 is latched, whether secured or unsecured, the box 12 can be carried comfortably and easily by the handle 62. The carrier does not need to be concerned that the contents will fall out of the storage area 20, because the latching mechanism will keep the lid 14 closed. As seen in FIG. 7, the body 12 can optionally include a pair of fastener apertures 90. The lock box 10 can be secured to a wall, bench, or other similar location be passing fasteners through the apertures 90 and into a stationary object.

The lock box 10 can be used to store items, such as keys, either in bulk or in an organized manner. To store items in bulk, the items can simply be placed in the storage area 20 without concern for order or organization. To store items in an organized manner, a variety of features can be incorporated into the storage area 20. For example, shelves, hooks, individual drawers or other such compartments can be built into the storage area 20. As shown in FIG. 10, a plurality of key holders 92 can be included in the storage area 20 to hold and organize keys 94. Each key holder 92 can be arranged to have a slot into which the blade of a key 94 can be placed. Identification labels can be affixed above or otherwise proximate to the key holders 92 to identify the key 94 that is held by the holder 90.

The lock box 10 can optionally include view apertures 96. As illustrated in the Figures, the lock box 10 has a plurality of view apertures 96 located on the lid 14 and body 12 of the box 10. These view apertures 96 allow for sight lines so that the contents of the lock box 10 can be observed and viewed when the lid 14 is closed. In addition, some of the apertures 96 can serve to allow light to enter the storage area 20 while the contents are viewed from other apertures 96. Based on the intended contents of the box 10, the apertures 96 can be sized to insure that the contents will not pass through or fall out of the apertures 96.

While various aspects of the invention are described and illustrated herein as embodied in combination in the exemplary embodiments, these various aspects may be realized in many alternative embodiments not shown, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

I claim:

1. A lock box for key storage comprising:

a. a shell defining an opening and comprising:

i. an inner key storage area accessible through the opening;

ii. a shell lock-receiving aperture; and iii. a shell cutout;

b. a lid for selectively covering the opening in a closed position, comprising:

i. a lid lock-receiving aperture;

ii. a cantilever spring aperture; and iii. a lid cutout located to selectively align with the shell cutout; and c. a substantially planar latching mechanism disposed between the shell and the lid, the latching mechanism being coupled to the lid and configured for longitudinal motion relative to the shell and the lid, the latching mechanism comprising:

i. a cantilever spring, including a main portion and an actuation portion; and ii. a first tab sized for insertion through the shell cutout and lid cutout and configured to be inserted into and removed from the shell cutout and the lid cutout by the longitudinal motion of the latching mechanism to selectively secure and release the lid from the shell;

wherein the lid is securable to the shell in the closed position by insertion of a lock through the shell lock-receiving aperture and lid lock-receiving aperture.

2. The lock box of claim 1 wherein the first tab selectively protrudes through the shell cutout and the lid cutout when the opening is in the closed position.

3. The lock box of claim 1 wherein the latching mechanism further includes a first notch;

further wherein, when the first tab protrudes though the shell cutout and the lid cutout, the first notch aligns with the lid lock-receiving aperture and when the first tab does not protrude through the shell cutout and the lid cutout, the first notch is misaligned with the lid lock-receiving aperture.

4. The lock box of claim 1 wherein the cantilever spring aperture comprises a first portion that can accommodate either the main portion or the actuation portion of the cantilever spring and a second portion that can accommodate the main portion of the cantilever spring.

5. The lock box of claim 1 wherein said shell includes a plurality of shell lock-receiving apertures and said lid comprises a plurality of said lid lock-receiving apertures, wherein each of said plurality of shell lock-receiving apertures is cooperatively aligned with each of said lid lock-receiving apertures when said lid is closed.

6. The lock box of claim 1 wherein said shell includes a plurality of shell lock-receiving apertures and said lid comprises a plurality of said lid lock-receiving apertures, wherein the lid is securable to the shell in the closed position by insertion of a plurality of locks through a plurality of shell lock-receiving apertures and a plurality of lid lock-receiving apertures.

7. The lock box of claim 1 wherein the body further includes at least one holder arranged to accommodate a key.

8. The lock box of claim 1 wherein the lid further includes a key slot that is accessible for key insertion when the lid is closed and secured by a lock.

9. A lock box for key storage comprising:

a. a body defining an opening and comprising:

i. an inner storage area, accessible from the opening;

ii. a first securing aperture; and iii. a first cutout;

b. a lid for selectively covering the opening, comprising:

i. a second securing aperture cooperatively positioned with the first securing aperture when the lid is positioned to cover the opening;

ii. a cantilever spring aperture, including a first portion and a second portion; and iii. a second cutout located to align with the first cutout when the lid is positioned to cover the opening; and c. a latching mechanism slideably coupled to the lid and having a latched position and an unlatched position, the latching mechanism comprising:

i. a cantilever spring, including a main portion and an actuation portion; and ii. a first tab;

wherein the first portion of the cantilever spring aperture can accommodate either the main portion or the actuation portion of the cantilever spring and the second portion of the cantilever spring aperture can accommodate only the main portion of the cantilever spring.

10. The lock box of claim 9 wherein when the latching mechanism is in the latched position, the first tab passes through the first and second cutouts and the main portion of the cantilever spring is fitted into the second portion of the cantilever spring aperture.

11. The lock box of claim 9 wherein when the latching mechanism is in the unlatched position, the actuation portion of the cantilever spring is fitted into the first portion of the cantilever spring aperture.

12. The lock box of claim 9 wherein the body further includes a notch, the notch includes a first portion and a second portion;

wherein the first portion of the notch can accommodate either the main portion or the actuation portion of the cantilever spring and the second portion of the notch can accommodate only the main portion of the cantilever spring.

13. The lock box of claim 10 wherein when the latching mechanism is in the latched position, the notch aligns with the cantilever spring aperture and the main portion of the cantilever spring is fitted into the second portion of the notch.

14. The lock box of claim 9 wherein the latching mechanism further comprises:

a. a first leg;

b. a second leg; and c. a connection member coupled to the first leg and the second leg;

wherein the cantilever spring is coupled to the connection member.

15. The lock box of claim 9 wherein the latching mechanism further includes a second tab, the body includes a third cutout, and the lid includes a fourth cutout;

wherein, when the latching mechanism is in the latched position, the second tab passes through the third and fourth cutouts.

16. The lock box of claim 9 wherein the latching mechanism further includes a first notch;

further wherein, when the latching mechanism is in the latched position, the first notch aligns with the second securing aperture and when the latching mechanism is in the unlatched position, the first notch is misaligned with the second aperture.

17. The lock box of claim 9 wherein the lid further includes a key slot.

18. The lock box of claim 9 wherein the lid further includes a slit and the latching mechanism includes a tongue;

wherein the tongue is slideably coupled to the slit.

19. The lock box of claim 9 wherein the latching mechanism further includes a handle.

20. The lock box of claim 19 wherein the latching mechanism is moved from an unlatched position to a latched position by moving the handle away from the lid.

21. The lock box of claim 19 wherein the latching mechanism is moved from a latched position to an unlatched position by moving the actuation portion of the cantilever spring to cause the main portion of the cantilever spring to move out of the second portion of the cantilever spring aperture and moving the handle towards the lid.

22. The lock box of claim 9 wherein the body further includes at least one holder arranged to accommodate a key.

23. A method of providing secured storage for a key that requires a first and second user to cooperatively act to access the key, the method comprising the following steps:

a. placing a key into a body of a lock box;
b. closing a lid of the lock box;
c. placing a latching mechanism into a latched position, which includes the step of engaging first and second aligned cutouts in the lid and the body of the lock box with corresponding first and second tabs on the latching mechanism by moving a handle of the latching mechanism away from the lid until a cantilever spring locates into a portion of an aperture in the lid of the lock box;
d. placing a first securing device through a first securing aperture in the body of the lock box and through a second securing aperture in the lid of the lock box;
e. locking the first securing device;
f. maintaining an ability to open the first securing device by the first user independent from the second user;
g. placing a second securing device through a third securing aperture in the body of the lock box and through a fourth securing aperture in the lid of the lock box;
h. locking the second securing device; and
i. maintaining an ability to open the second securing device by the second user independent from the first user.

24. A lock box for key storage comprising:

a. a body defining an opening and comprising:
  i. an inner storage area, accessible from the opening;
  ii. a first securing aperture; and
  iii. a first cutout;
b. a lid for selectively covering the opening, comprising:
  i. a second securing aperture cooperatively positioned with the first securing aperture when the lid is positioned to cover the opening; and
  iii. a second cutout located to align with the first cutout to form a latch aperture when the lid is positioned to cover the opening; and
c. a latching mechanism configured for longitudinal motion with respect to the body and the lid and slideably coupled to the lid, the latching mechanism being longitudinally moveable through the latch aperture, and having a latched position.

25. A lock box for key storage comprising:

a. a shell defining an opening and comprising:
  i. an inner key storage area accessible through the opening;
  ii. a shell lock-receiving aperture; and
  iii. first and second shell cutouts;
b. a lid for selectively covering the opening in a closed position, comprising:
  i. a lid lock-receiving aperture;
  ii. a cantilever spring aperture; and
  iii. first and second lid cutouts located to selectively align with the first and second shell cutouts, respectively; and
c. a latching mechanism coupled to the lid and comprising:
  i. a cantilever spring, including a main portion and an actuation portion; and
  ii. first and second tabs sized for insertion through the first and second shell cutouts and lid cutouts, respectively;

wherein the lid is securable to the shell in the closed position by insertion of a lock through the shell lock-receiving aperture and lid lock-receiving aperture.

26. A lock box for key storage comprising:

a. a body defining an opening and comprising:
  i. an inner storage area, accessible from the opening;
  ii. a first securing aperture; and
  iii. a first cutout and a third cutout;
b. a lid for selectively covering the opening, comprising:
  i. a second securing aperture cooperatively positioned with the first securing aperture when the lid is positioned to cover the opening;
  ii. a cantilever spring aperture, including a first portion and a second portion; and
  iii. a second cutout and a fourth cutout located to align with the first cutout and third cutout, respectively when the lid is positioned to cover the opening; and
c. a latching mechanism slideably coupled to the lid and having a latched position and an unlatched position, the latching mechanism comprising:
  i. a cantilever spring, including a main portion and an actuation portion; and
  ii. a first tab;
  iii. a second tab;

wherein the first portion of the cantilever spring aperture can accommodate either the main portion or the actuation portion of the cantilever spring and the second portion of the cantilever spring aperture can accommodate only the main portion of the cantilever spring.

* * * * *